US005108095A

United States Patent [19]

Nichols

[11] Patent Number: 5,108,095

[45] Date of Patent: Apr. 28, 1992

[54] SQUAT EXERCISE APPARATUS

[75] Inventor: Raymond L. Nichols, Cleveland, Tenn.

[73] Assignee: Southern Xercise, Inc., Cleveland, Tenn.

[21] Appl. No.: 626,611

[22] Filed: Dec. 7, 1990

[51] Int. Cl.[5] ..... A63B 21/00

[52] U.S. Cl. ..... 482/137; 482/97

[58] Field of Search ..... 272/70, 97, 117, 118, 272/120, 123, 130, 134, 136, 142, 143, 144, DIG. 4; 128/25 R

[56] References Cited

U.S. PATENT DOCUMENTS

| | | | |
|---|---|---|---|
| 2,783,045 | 2/1957 | Bosch . | |
| 3,003,765 | 10/1961 | Dove . | |
| 3,573,865 | 4/1971 | Annas | 272/117 |
| 3,856,297 | 12/1974 | Schnell | 272/117 |
| 4,236,712 | 12/1980 | Lambert, Jr. et al. | 272/118 |
| 4,333,644 | 6/1982 | Lambert, Jr. et al. | 272/118 |
| 4,411,424 | 10/1983 | Barnett | 272/118 |
| 4,603,855 | 8/1986 | Sebelle | 272/117 |
| 4,607,840 | 8/1986 | Harper | 272/117 |
| 4,621,810 | 11/1986 | Cummins | 272/134 |
| 4,635,926 | 1/1987 | Minkow | 272/118 |
| 4,669,724 | 6/1987 | Matheisen | 272/DIG. 4 X |
| 4,700,946 | 10/1987 | Breunig | 272/134 |
| 4,872,670 | 10/1989 | Nichols | 272/134 |
| 4,890,830 | 1/1990 | Kern | 272/117 |

FOREIGN PATENT DOCUMENTS

| | | |
|---|---|---|
| 0177017 | 4/1986 | European Pat. Off. . |
| 485745 | 3/1976 | U.S.S.R. . |

*Primary Examiner*—Robert Bahr

*Attorney, Agent, or Firm*—Luedeka, Hodges, Neely & Graham

[57] ABSTRACT

An apparatus utilizing squat maneuvers is provided for exercising and/or rehabilitating muscles and joints in the lower back, hip and legs. A single carriage assembly comprising four elongated members pivotably connected in the form of a rectanglar provide a parallelogram-type arrangement which provides a pantographic-type motion to a vertically oriented back support that is supported in cantilever fashion by a vertically disposed member of the carriage assembly. The back support is maintained in its vertical orientation during squat maneuvers while being moved along an arcuate path as provided by the pantographic motion of the carriage assembly. The elongated members of the single carriage assembly are formed of structures exhibiting high resistance to twisting moments and the pivotal connections between these members are of near pressed-fit tolerances so as to inhibit any looseness at the pivotal connections which could cause binding at the pivotal connections during squat maneuvers. Adjustable shoulder blocks and a transverse rod associated with the back support are adapted to be contacted by the user for effecting squat maneuvers including bar bell-type squats.

18 Claims, 5 Drawing Sheets

SQUAT EXERCISE APPARATUS

BACKGROUND OF THE INVENTION

The present invention relates generally to an apparatus for exercising and rehabilitating muscles and joints, and more particularly to such an apparatus in which squat procedures or maneuvers are utilized for exercising and developing muscles as well as the exercising and rehabilitation of muscles and joints associated with acute, chronic and post surgical leg, hip, and lower back pathologies.

Presently available exercise devices utilizing a myriad of different motions and procedures have been employed for exercising the muscles and joints of human beings. Some of these available exercise devices utilize squat-type maneuvers for the purpose of exercising and rehabilitating leg and lower back muscles. Of these devices employing squat-type maneuvers, it has been found that all but one previously known device require the user to undergo an unnatural squatting motion which limits the exercise and rehabilitation maneuvers to only certain groups of muscles and joints while at the same time placing an excessive load or strain on other muscles and joints. For example, substantial shear forces present at the knee that occur during unnatural squatting motions where the knee extends forwardly over the toes of the user are instrumental in causing retro-patellar crepitus and patellofemoral disease.

The exception to the known squat-type exercise devices that provides squatting motions which closely approximates natural squatting motions is described in U.S. Pat. No. 4,872,670, issued to Raymond L. Nichols and entitled "Apparatus For Squat Exercise."

This patented apparatus generally comprises a vertical back support mounted between a pair of parallelogram-type side assemblies which provide a pantographic-type motion to the back support. During this pantographic motion the back support remains vertically upright while following an arcuate path so as to allow the user to squat in a motion closely imitating the natural squat motion of the user. With the back support moving in a arcuate path with the back support vertically oriented, the knees are prevented from extending over the toes of the user which thereby inhibits the occurrence of substantial tibio-femoral shear forces on the patella and the tibia so as to obviate or at least significantly minimize the retro-patellar crepitus and patellafemoral disease problems as mentioned above. The arcuate motion of the seat of a back support while traveling the arcuate path also inhibits undesirable joint movement so as to minimize any lumbar stress which may occur during squat exercises.

The aforementioned patented squat exercise apparatus is particularly useful for providing knee rehabilitation meneuvers such as required for rehabilitating of the anterior-cruciate ligament. The use of this patented apparatus has also been found to be particularly valuable for the rehabilitation of leg, hip, and back muscles associated with acute, chronic, and post-surgical pathologies especially since the lumbar and thoracic spine stabilizations as well as critical tibio-femoral angles are easily controlled. On the other hand, such thoracic spine stabilizations and tibio-femoral angles were found to be difficult to control when using other previously known squat exercise machines. Further, the use of this patented apparatus by a user having a leg prothesis is advantageous for the exercise of lower back and any thigh muscles since the lower leg and the prothesis below the knee are maintained in an essentially vertical plane during the entire exercise regimen so as to prevent the aforementioned undesirable tibio-femoral stresses from occurring. The patented device is also adjustable to fit users of different physical statures while affording desirable squatting motions.

While the aforementioned patented apparatus utilizing squat exercise maneuvers provides many advantages such as listed above that are not believed to be achievable in other known squat-type exercise machines employing squat maneuvers and can be readily adjusted for utilization by users of various physical make-up and stature, there are several attendant shortcomings or drawbacks to the aforementioned patented apparatus due to its construction but not to its function in the areas of muscle and joint exercising and rehabilitation, which detract from the overall acceptability of the apparatus. For example, the aforementioned patented apparatus is of a relatively complex construction which requires the use of a pair of identically constructed parallelogram-type side assemblies for supporting the back support therebetween in order to provide the required pantographic motion. This double-side assembly necessitates that the dimensions of the apparatus, especially the width thereof, be relatively large to assure easy ingress and egress of the user to and from the back support-containing area between the side assemblies and to also assure that the user has sufficient maneuvering room between the side assemblies to assume a proper position against the vertically oriented back support. The width of the assembled apparatus required to achieve these goals is such that the apparatus will not fit through conventionally-sized doorways. Thus, it was found to be necessary to either use the patented apparatus in areas accessible through relatively large doorways, such as double doors, or by disassembling and subsequently reassembling the apparatus in areas accessible through conventionally-sized doorways. Another drawback of the patented apparatus is due to its weight in that when assembled as described in the aforementioned patent the weight of the apparatus is approximately 500 lbs. Thus, the weight and the size of the apparatus resulted in the apparatus being quite cumbersome and awkward for moving or shipping purposes. A still further shortcoming in the patented apparatus is due to the relatively high construction costs thereof which tend to detract from the acceptability of the patented apparatus in some facilities such as in the home.

The present invention is directed to a modification of the patented apparatus which, apart from the aforementioned and other shortcomings or drawbacks of the patented apparatus, functions in a manner substantially similar to that in the patented apparatus. Thus, the aforementioned patent is incorporated herein by reference.

SUMMARY OF THE INVENTION

It is an object of the present invention to provide a squat exercise apparatus of relatively simple construction that is capable of providing all the advantages and functions realized by the aforementioned patented apparatus in muscle and joint exercise and rehabilitation regimens, especially those relating to the lower back, hip, thigh, and knee areas. The present invention provides for such an apparatus with desirable physical properties including a weight of less than about one-half the weight of the patented apparatus and dimensions which will provide for easy passage of the present invention through conventionally-sized doorways. In accordance with the object of the present invention the inventors have unexpectedly found that the aforementioned desirable pantographic motion can be provided for displacing a vertically oriented back support along an arcuate path in the same manner as in the aforementioned patented apparatus by cantileveredly supporting the back support on a single parallelogram-type carriage assembly but without encountering any of the expected twisting or binding conditions which would detract from or otherwise hinder the operation of the present apparatus. Generally, this object is achieved by constructing the parallelogram carriage or frame assembly of structural materials which are relatively light weight but which are characterized by possessing substantial resistance to torque or twisting moments. These components form the arms or legs or members of the single frame assembly and are joined together at pivot points by using a connecting arrangement having relatively close tolerances between relatively movable parts so as to provide for pivotal motion between the structural frame members in a essentially non-binding manner when the back support is cantileveredly supported by an outboard member of the frame assembly.

More specifically, the apparatus of the present invention comprises a horizontally oriented base means. A single vertically displaceable frame means is pivotally attached to the base means and comprises uniformly spaced apart elongated upper and lower members connected to uniformly spaced apart elongated first and second end members at vertically spaced apart locations thereon for defining a parallelogram of the interconnected members. The first end member is fixedly attached to the base means and vertically extends upright therefrom. The upper and lower members are each pivotally attached at one end thereof to the first end member and at an opposite or outboard end thereof to the second end member. With this arrangement of the members, the vertical displacement of the frame means provides for vertically displacing the second end member along an arcuate path while maintaining the frame means in the form of a parallelogram to maintain the second end member in a plane perpendicular to the base means and parallel to the first end member. An elongated back support means disposed in a vertical plane at a location laterally spaced from the frame means and overlying the base means is cantileveredly supported by the second end member of the frame means in the vertical orientation for displacement thereof along the desired arcuate path while maintaining the back support means perpendicular to the base means. Means associated with the back support means are adapted to be contacted by the user while the back of the user bears against the back support means for effecting displacement of the back support means along the desired arcuate path.

The members defining the frame means are sufficiently resistant to twisting moments over the lengths thereof and the pivotable attachments between the members are sufficiently rigid to resist bending moments at the pivotable attachments so as to inhibit binding at the pivotable attachments during vertical displacement of the back support means. The pivotal attachments between contiguously disposed portions of the frame members are provided by the shaft means which extend between and engage the adjacent frame members with essentially pressed-fit tolerances at the connections therebetween to provide an axis of rotation to the upper and lower members for permitting pivotable movement thereof with respect to the first and second end members.

Another object of the present invention is to provide for the construction of an apparatus capable of achieving the aforementioned desired squat maneuvers whereby substantial cost savings can be realized over those required for the construction of the apparatus described in the aforementioned patent.

Another object of the present invention is to provide a telescoping counter balance arrangement where any desired range of counter balancing can be readily achieved.

A further object of the present invention is to provide a plurality of selectable stops for between a fully upright position and full squat position for providing a limit to the squat motion corresponding to a desired extent of the full squat motion in a manner exhibiting greater flexibility in the selection of the squat positions attainable than available in the aforementioned patented apparatus.

A still further object of the present invention is to provide an arrangement utilized in cooperation with the back support whereby bar bell-type back squats may be achieved.

Other and further objects of the present invention will become obvious upon an understanding of the illustrative embodiments about to be described or will be indicated in the appended claims, and various advantages not referred to herein will occur to one skilled in the art upon employment of the invention in practice.

DESCRIPTION OF THE INVENTION

Figure 1:
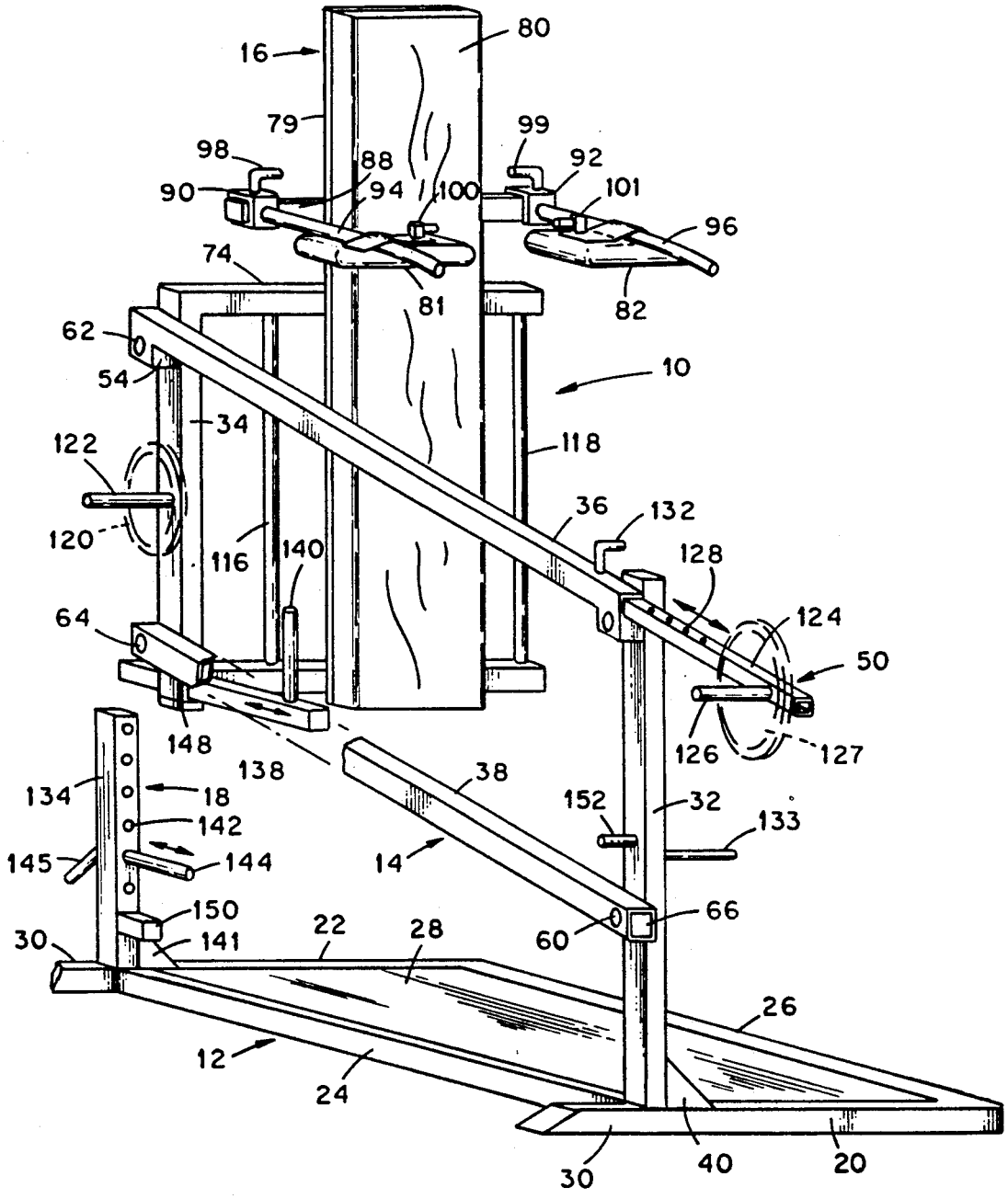
FIG. 1 is a perspective view of the exercise apparatus embodying the present invention.

As shown in the drawings the exercise device or apparatus 10 embodying the present invention comprises a base assembly 12, a single carriage or frame assembly 14 cantileveredly supporting a vertically displaceable back support assembly 16, and an adjustable stop assembly 18 for limiting the vertical displacement of the back support assembly to any of several levels of a full squat maneuver.

The base assembly 12 is used to support the working components of the present invention and is shown comprising front and rear members 20 and 22 and side members 24 and 26 joined together in rectangular configuration. The front, rear and side members of the base assembly may be formed of any suitable strong and rigid material of relatively light weight such as steel or aluminum in the form channel or tubular stock. The base members may be joined together in any suitable manner such as welding or the like. A platform or tread plate 28 is preferably supported within the framework provided by front, rear, and side members. Also, suitable extensions 30 may be placed on the side member 24 of the base assembly at longitudinally spaced apart locations generally underlying the carriage assembly 14 for adding additional support for the latter. These extensions 30 may be removably attached to the side member 24 in any suitable manner such as bayonet-type connections, so as to facilitate the shipping and moving of the apparatus.

The single carriage or frame assembly 14 is formed of four elongated legs or members arranged in the form of a parallelogram and interconnected in a pivotable manner. The frame assembly 14 cantileveredly supports the back support assembly 16 while providing for the displacement of the back support assembly 16 along an arcuate path as provided by the pantographic motion supplied by the parallelogram construction of the frame assembly 14. As shown best in FIG. 1, the carriage assembly or frame assembly 14 comprises a front frame member 32, a rear frame member 34, and upper and lower frame members 36 and 38 respectively. The front frame member 32 is affixed to the base assembly 12 in an upright orientation at a location at the intersection between the front base member 20 and the side base member 24 of base assembly 12. The front frame member 32 is rigidly attached to the base member 20 or 24 by welding of the like so as to remain in a vertically upright position during all squat maneuvers. A gusset 40 may be attached between the upright front frame member 32 and front base member 20 of the base assembly 12 to add additional support to the upright front frame member 32. The upper and lower frame members 36 and 38 ar pivotably attached at the inboard ends thereof to the front frame member 32 at vertically spaced apart locations thereon and at the outboard ends thereof to the rear frame member 34 at similar vertically and longitudinally spaced apart locations so as to define a parallelogram. The upper and lower frame members 36 and 38 are uniformly spaced apart from one another a distance of about 8 to about 40 inches which is sufficient to assure that the pantographic motion can be achieved by the frame assembly 14 without any undesirable binding or tilting. If the side frame members 36 and 38 are closer than about 8 inches, the frame assembly 14 would not possess sufficient strength to inhibit binding at the connection between the frame members and the tilting of the back support assembly 16 during squat maneuvers.

The frame members of the carriage assembly 14 are suitably formed of rectangular steel tubing, preferably square tubing, due to the high strength-to-weight ratio and the relatively high resistance to twisting or torquing moments over the length thereof. The size of the tubing found to be satisfactory for the construction of the frame members 32, 34, 36, and 38 can be varied depending upon the level of use of the apparatus. For example, 11 gauge, 2 inch square tubing is satisfactory for the construction of a squat exercise apparatus to be used in relatively heavy duty applications such as in sports medicine and physical therapy clinics, fitness facilities by athletes, and any other use or facility requiring heavy weight resistance during squat maneuvers. On the other hand, 11 gauge square tubing of a smaller cross section, i.e., about 1.5 inches is suitable for the construction of a squat exercise apparatus subject to light use such as normally required by geriatrics, home use, and other applications where relatively low weight resistance is required by the user during the various squat maneuvers. These squat exercise apparatus embodying all the features of the present invention can be readily constructed with a shipping weight of about 230 lbs. for the heavy duty apparatus and about 130 lbs. for the light duty apparatus. Of course, it will appear clear that rectangular tubing of other materials such as aluminum or other high strength metals or alloys may be used in place of the steel tubing. Further, rectangular tubing of various wall thicknesses other than 11 gauge and other cross-sectional dimensions different from those mentioned above may be satisfactorily used in the practice of the present invention. Also, while the various members of the base assembly 12, the frame assembly 14, and the back support assembly 16 are preferably formed of rectangular steel tubing, it will appear clear that the members and components of these assemblies may be constructed of suitable materials having configurations different than that of rectangular tubing. For example, the base assembly 12, the back support assembly 16, and even one or more of the frame members in the frame assembly may be formed of channel stock.

In accordance with the present invention, the pivotable connections between the frame members 32, 34, 36, and 38 are required to be sufficiently snug, i.e., with near pressed-fit tolerances with relatively large areas of contact so as to negate or at least substantially prevent any binding from occurring between the frame assembly members during the vertical displacement of the back support assembly 16. As best shown in FIGS. 3–5 and 9, the pivot couplings or connections between the tubular frame members 32, 34, 36, and 38 are preferably provided by placing solid steel plugs, as shown at 41 and 42 in frame member 32 and at 44 in frame member 34. The frame member 34 at the juncture with frame member 38 is provided with a solid plug similar to that shown at 44 in the end portion of frame member 34.

With the embodiment of the invention shown in FIG. 1, the upper frame member 36 is provided with and supports a counter balance weight assembly 50 which is telescopically received within in the upper hollow frame member 36. In order to provide for this feature, the frame member 36 is provided with flange-like segments 52 and 54 of tubing coupled by welding or the like to the inboard and outboard ends of the upper frame member 36 so as to provide the upper frame member 36 with a passageway 55 therein for telescopically receiving a elongated portion of the counter balance assembly 50, as will be described in greater detail below. The plugs 41, 42, 44 and the plug in frame member 34 at the juncture between the frame members 34 and 38 as well as the frame members 32, 34, 36 and 38 at the points of intersection therebetween are provided with horizontally extending throughgoing bores 56 which are disposed parallel to the planar surface of the base assembly 12. Into each bore 56 is inserted a hardened steel rod or shaft such as shown at 58 and 60 at the junctures of the front frame member 32 with the upper and lower frame members 36 and 38 and at 62 and 64 at the junctures of the rear frame member 34 with the upper and lower frame members 36 and 38. The shafts 58 and 62 are fixedly attached to the flange segments 52 and 54 on frame member 36 and shafts 60 and 64 are fixedly attached to the frame member 38. Preferably, these shafts are welded at the points of contact with the flange segments 52 and 54 and the frame member 38. The weldments are preferably on the inside of the tubular stock as shown generally at 65 in FIG. 5. The open ends of the frame member 38 and the flange segments 52 and 54 may be covered with a suitable covering such as provided by placing a thin insert of plastic or metal as generally shown at 69 in the open ends.

Figure 4:
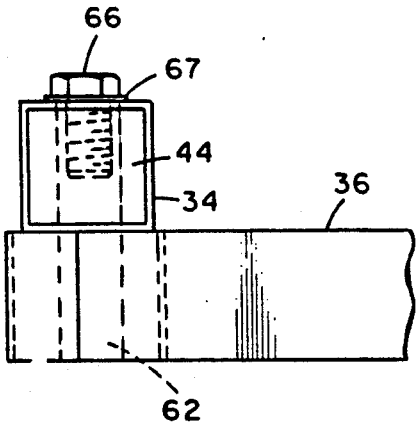
Figure 5:
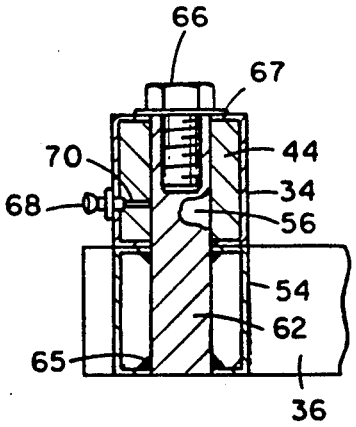
Figure 6:
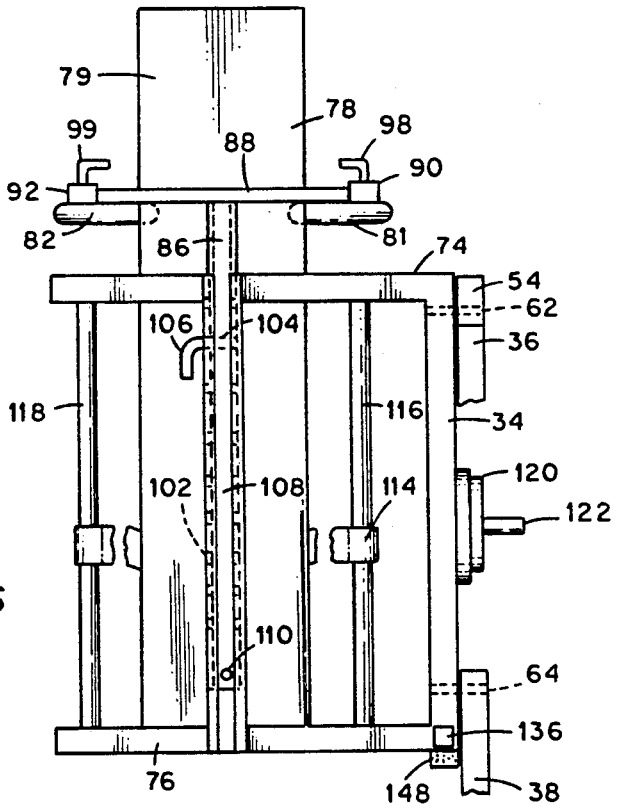
FIG. 6 is an elevational back view of the back support assembly.
Figure 7:
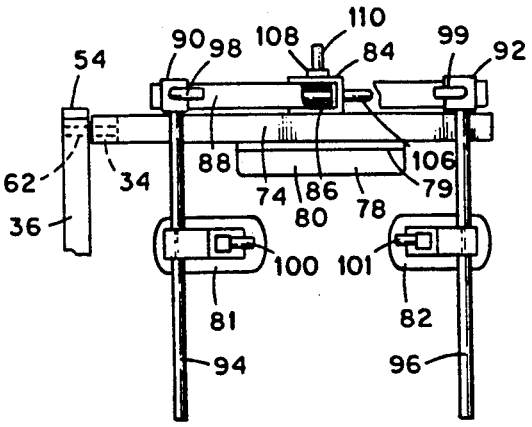
FIG. 7 is a top view showing details of the back support assembly.

The shafts 58, 60, 62 and 64 in the bores 56 provide a pivot axis for the upper and lower frame members 36 and 38 for effecting the pantographic motion required of the frame assembly 14. In order to assure that this motion required of the frame assembly 14 with the back support assembly 16 cantileveredly attached thereto is achieved in an essentially unbinding manner, the shafts 58, 60, 62, and 64 are of a relatively large diameter, preferably in the range of about ¾ to 1 inch, and are received within the bores 56 in the plugs 41, 42, 44 and the plug in frame member 34 at the juncture between frame members 34 and 38 in a near pressed-fit tolerance so as to prevent any play or looseness between the shafts and the walls of the bores 56 which would be conducive to binding between the frame members during relative movement therebetween. This close fit between the shafts 58, 60, 62, and 64 and the walls of the bores 56 in the plugs is preferably provided by drilling the bores 56 slightly undersized and then reaming the bores to an essentially machine fit with the shafts as provided by tolerances in the range of essentially zero up to about 0.004 inch oversize. The shafts 58, 60, 62, and 64 and the bores 56 extend through the entire cross section of the frame members and the solid plugs in frame members 32 and 34 so as to provide a sufficient surface area for contact between the shafts and the walls of the bores 56 to spread the contacting area over a considerable area and thereby further inhibit any binding in the carriage assembly 14 as it is displaced through its various motions. As shown in FIGS. 4 and 5, a bolt 66 is threadily received in the outboard end of the shaft 62 over a washer 57 in order to help retain the shaft 62 in the bore 56 while permitting relative movement between the frame members 34 and 36. Each of the other shafts 58, 60, and 64 are provided with a similar bolt and washer arrangement (not shown).

In order to assure that the pivoting motion is achieved without undue friction between the shafts 58, 60, 62, and 64 and the walls of the bores 56 in the plugs 41, 42, 44 and the plug in the tubular member 34 contacted by shaft 64, a suitable lubricant may be introduced at the interface between the shafts and the bores by employing a suitable lubricating arrangement. For example, as shown in FIG. 5, a zerk 68 may be attached to the frame member 34 with a bore 70 extending through the plug 44 to the interface between the shaft 62 and the bore 56 so that a suitable lubricant may be introduced at the interface therebetween.

While the plugs are shown in the frame members 3 and 34 and the shafts welded to the tubular stock forming the frame members 36 and 38, it will appear clear that this arrangement may be readily reversed.

The lower frame member 38 is attached to the front frame member 32 at a location sufficiently above the upper surface of base assembly 12 so that the outboard end of lower frame member 38 is at a level lower than the juncture between frame members 32 and 38 when the back support assembly is at its lowermost limit of travel as provided by a full squat. This arrangement assures that the back support assembly 16 travels an arcuate path as would occur during a natural squat by the user.

The back support assembly 16, as best shown in FIGS. 1, 2, and 6–8, comprises horizontally extending back frame members 74 and 76 attached at the inboard ends thereof to the rear frame member 34 at end portions thereon preferably located above and below the pivot attachment of the frame member 34 with the upper and lower frame members 36 and 38 respectively. These frame members 74 and 76 horizontally extend from the rear frame member 34 to a location laterally spaced therefrom, preferably to a location overlying the edge of the base assembly 12 as defined by side member 26 and are vertically spaced apart from one another to provide adequate support to a back support 78 attached thereto. This back support 78 is preferably provided by a rectangular body 79 of wood, aluminum, or any other suitable material including plastics, and includes a padded surface 80 over the full face thereof for contact by the user. The back support 78 is of a suitable length for providing a comfortable fit for the user when the back of the user is positioned against the back support 78 during squat motions regardless of the stature of the user. The back support 78 is attached to the back support frame members 74 and 76 at a location horizontally spaced from the rear member 34 as well as the outboard or distal ends of the back support frames 74 and 76. Bolts or the like, not shown, may be used to secure the back support 78 to the back support frames 74 and 76. The lowermost end of the back support 78, when attached to the back support frames 74 and 76, is at such a height that the back support 78 will not contact the base assembly 12 when the user utilizes a full squat maneuver.

The back support frame members 74 and 76 also serve as a mount for a pair of shoulder blocks 81 and 8 positioned on opposite sides of the back support 78 at a location above the upper back support frame member 74. These shoulder blocks 81 and 82 are adapted to be contacted by the shoulders of the user during the use of the present invention and are mounted for vertical displacement on the back support frame members 74 and 76 to tailor the positioning of the shoulder blocks 81 and 82 for use by users of different statures. A suitable, adjustable amount for the vertical displacement of the shoulder blocks 81 and 82 may be provided by securing an elongated vertically oriented rectangle tubular member 84 to the frame support 74 and 76 at locations between the vertical sides of the back support 78 on the backside thereof. A elongated tubular member 86 is adapted to be telescopically received within the hollow tubular member 84 and has the upper end thereof secured to a horizontal cross member 88 which may be of rectangular tubular stock. The outboard ends of this cross member 88 serve to slidably receive collars 90 and 92 thereon. These collars 90 and 92 in turn, are connected to and support elongated arms 94 and 96 which project parallel to one another from the collars 90 and 92 along the side edges of the back support 78. These elongated arms 94 and 96 are preferably formed of round tubing of a diameter in the range of about $\frac{7}{8}$ to 1 inch and extend horizontally from the collars 90 and 92 a sufficient distance to provide support of the shoulder blocks 81 and 82 as well as to provide end portions thereon suitable for grasping by the user for facilitating the squat operation. The outer end of the arms 94 and 96 remote to the collars 90 and 92 are each preferably provided with a downwardly bent portion disposed at an angle of about 5° to 10° to the horizontal base assembly 12 for further facilitating the grasping of these outer ends of the arms 94 and 96 by the user. The collars 90 and 92 may be secured to the cross arm 88 by using any suitable attaching means which would provide selective positioning of the shoulder blocks 81 and 82 along the length of the cross arm 88 so as to provide the spacing between the shoulder blocks 81 and 82 desired by the user. For example, clamps 98 and 99 with cam-type locks or set-screws and with suitable handles thereon may be used to hold the collars 90 and 92 on the cross arm 88. Similar type clamps 100 and 101 may be used to selectively position the shoulder blocks 81 and 82 on the arms 94 and 96 at the desired spacing from the back support 78 for fitting the shoulders of the user.

The vertical positioning of the shoulder blocks 81 and 82 to a location desired by the user is achieved when the back of the user is in contact with the back support 78 and the user is in a full upright or standing position. This positioning of the shoulder blocks 81 and 82 is readily achieved by providing the movable tubular member 86 with a plurality of closely spaced apart horizontal bores 102 and the vertical channel member 84 receiving the movable member 86 with a single horizontal bore 104. As the shoulder blocks 81 and 82 are moved by the user into a selected vertical position a removable pin 106 is passed through bore 104 into a bore 102 aligned therewith to fix the shoulder blocks 81 and 82 at the desired vertical location. A suitable vertically extending, elongated arm 108 with a handle 110 at the lower end thereof may be affixed to the tubular member 86 at a location near the upper end thereof to provide for the displacement of the tubular member 86 within the channel member 84.

If desired more precise vertical positioning of the shoulder blocks 81 and 82 may be readily achieved by using a suitable hydraulic or pneumatic servo system supported by the back support frames 74 and 76 and attached to the cross arm 88 or to the tubular member 86.

A suitable harness such as a belt 114 is supported by the back assembly 16 for placement about the waist of the user for assisting and maintaining the back of the user in a desirable contacting relationship with the back support 78 during all stages of the squat maneuvers. This belt 114 is preferably positionable at different vertical heights on the back support 78 by employing a pair of vertical rods 116 and 118 adjacent to each side of the back support 78 and extending between back support frame members 74 and 76. Looped end portions of the belt 114 are attached to these vertical rods 116 and 118 and are slidable thereon in either vertical direction so as to position the belt 114 at the height providing a desirable fit around the waist of the user.

In the present invention, as in the aforementioned patented apparatus, removable weights are placed on the carriage assembly 14 near the back support assembly 16 so as to provide the selected resistance to the lifting force to be encountered by the user during desired squat maneuvers. These weights are used in conjunction with the counter balance 50 and are attached to the frame assembly 14 on the outboard side thereof with respect to the back support assembly 16. These weights, as generally shown at 120, are preferably supported on the outboard side of the rear frame support member 34 by employing a horizontally disposed rod 122 of a sufficient length to support a suitable number of bar bell type weights 120.

Figure 9:
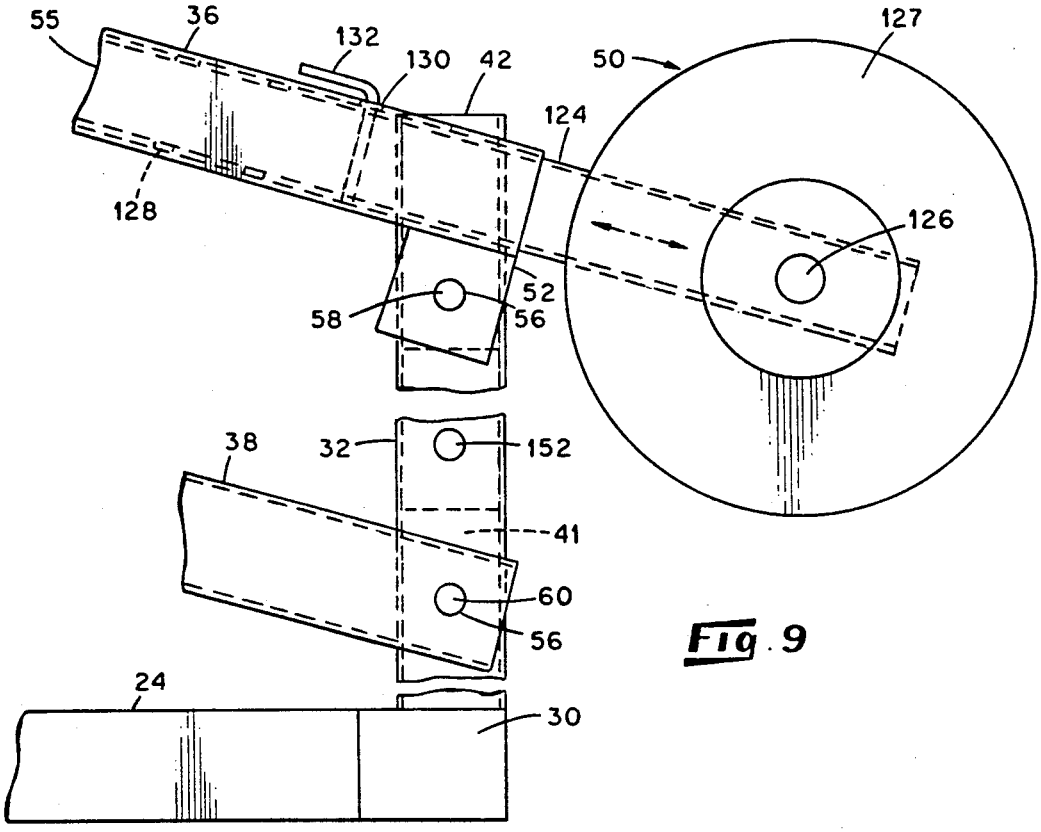
FIG. 9 is a fragmentary side view showing an embodiment of the telescoping counter balancing arrangement.

As shown in the embodiment of FIGS. 1 and 9, the upper member 36 of the parallelogram frame assembly 14 provides for the support of the counter balancing weight assembly 50 at the end thereof attached to the front frame member 32. In this embodiment an elongated body 124 of tubular stock of a cross section slightly less than that within the hollow interior of the upper frame member 36 and defining the passageway 55 is telescopically receivable in the passageway 55 through the open end of the upper frame member 36. A horizontally extending rod 126 preferably disposed on the same side of the frame assembly 14 as the weights 120 provides support for bell-type weights 127 used for providing the desired level of counter balancing. With the weights 127 attached to the end of the tubular body 124, the body 124 is extendable from the passageway 55 in upper frame member 36 until the desired counter balancing of the frame assembly 14 and the back support assembly 16 is achieved. The desired level of counter balancing is readily achieved by providing the tubular body 124 with a plurality of longitudinally spaced apart bores 128 and a single bore 130 in the upper frame member 36 at a location adjacent to the end thereof attached to the front frame member 32. A removable pin 132 may then be used to lock the telescoping tubular body 124 in place within the upper frame member 36 when the desired level of counter balancing is achieved. If desired, the frame member 32 may be provided with a horizontally extending rod 133 on the inboard side thereof for storing the weights 120 and 127.

In the operation of the present invention, the counter balance weight 127 is preferably positioned prior to adding the lift-resisting weights 120 to the frame assembly 14 so as to provide a desired level of balance of the back support assembly about a pivot point providing connections of the front frame member 32 to the upper and lower frame members 36 and 38. The weights 120 are then added to provide the weight selected for resisting the upward portion of the squat maneuver. In some instances, the counter balancing weights 127 can be used in squat maneuvers without using the weights 120 so as to provide a level of lift resistance suitable for use in exercise and rehabilitation regimens such as desired in the early stages of post-operative muscle and joint rehabilitation. The positioning of the counter balance weights 127 closer to the front frame member 32 serves to increase the lifting resistance in the same manner as adding weights 120 but to a lesser degree. However, in some rehabilitation exercise it may be desirable to move the counter balance weights further away from the front frame member 32 and beyond the usual counter balancing position so that some downwardly exerted force will be required for achieving the downward squat segment of the squat maneuver.

With the squat apparatus counter balanced by appropriately positioning the telescopically movable counter balance and with the weights 120 of the desired loading placed on the rod 122, the back support assembly 16 must be initially restrained from being vertically displaced from its initial position towards the base assembly 12. This initial restraint may be readily provided by using a back support positioning assembly 18 which is used to hold the back support assembly 16 at a location where the user is standing upright in position against the back support 78 and with the shoulders of the user contacting the shoulder support blocks 81 and 82. The back support positioning assembly 18 also provides for the stopping of the downward displacement of the back support 78 at selected locations indicative of the degree of full squat desired.

Figure 2:
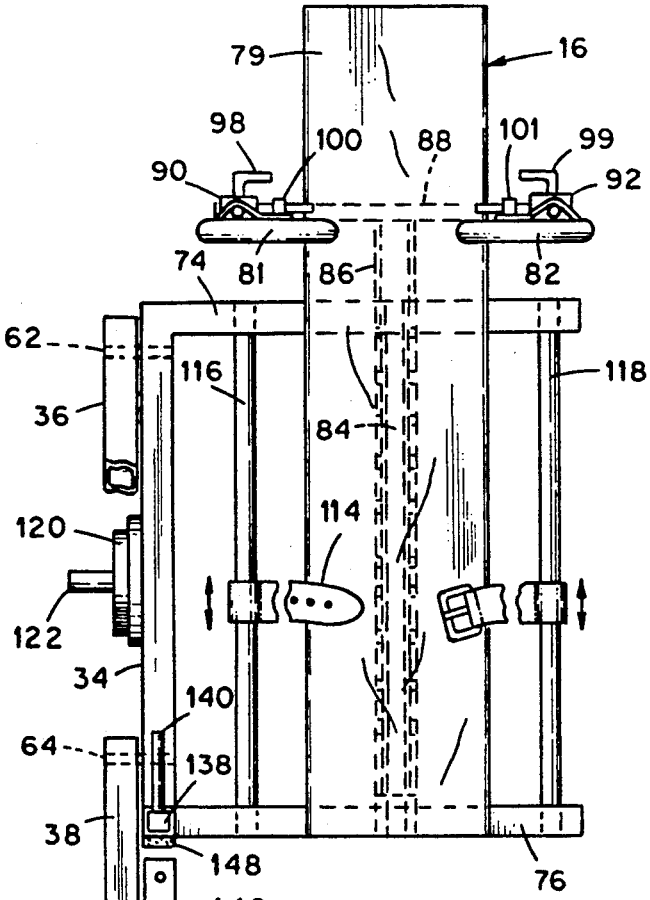
FIG. 2 is an elevation front view of FIG. 1 illustrating the cantileveredly supported back support.
Figure 8:
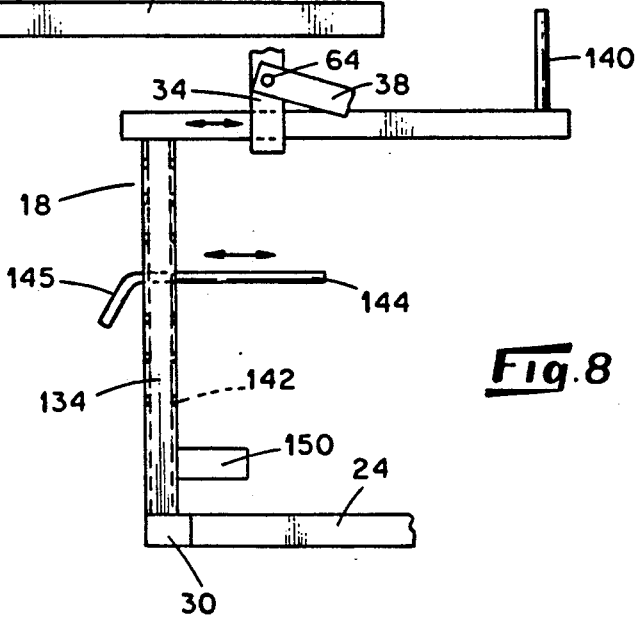
FIG. 8 is a side elevational view showing details of the mechanism used for controlling the vertical displacement of the back support assembly.
Figure 3:
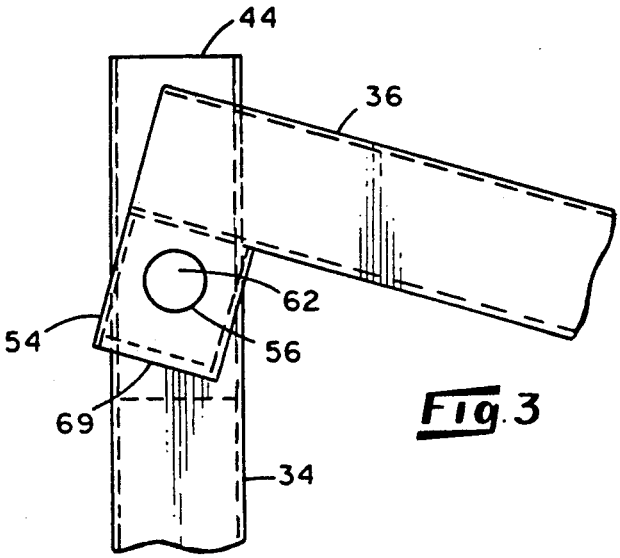
FIGS. 3, 4, and 5 are fragmentary views showing details of the interconnection between the relatively moveable members of the single carriage or frame assembly.

As best shown in FIGS. 1, 2, and 8, the back support positioning assembly 18 of the present invention is of a relatively simple and light weight construction and is yet capable of providing for a wide range of squat positions. The back support positioning assembly 18 is shown comprising a vertically oriented post 134 of square tubular stock affixed to the side member 24 of the base assembly 12 at a location on a vertical plane parallel with the rear member 34 but at a location longitudinally rearwardly spaced thereof. As shown, the lowermost end of the rear frame member 34 is provided with a horizontally displaced, rectangular throughgoing passageway 136 in which an elongated tubular member 138 of a cross section less than that of the passageway 136 is telescopically received. Thus, with back support assembly 16 in its initial position, as mentioned above, the elongated tubular member 138 is positioned within the passageway 136 so that the distal or outboard end thereof rests on top of the post 134 and thereby prevents any downward displacement of the back support assembly 16. While the tubular member 138 is so positioned, the weights 120 desired for the squat exercise may be placed on the rod 122. When it is desired to bring the squat apparatus into operation for effecting the desired squat maneuvers, the tubular member 138 is moved forwardly in the passageway 136 to remove the end thereof from engagement with the top of the post 134. This movement of the tubular member 138 may be readily achieved by placing a simple vertically oriented rod 140 in the tubular member 138 near the end thereof on the side contiguous to the padded side of back support 78 contacted by the user so that the user, while in position against the back support 78, may merely grasp the rod 140 and move the tubular member 138 into or out of engagement with the post 134. A gusset 141 may be placed at the base of the post 134 to add additional support thereto.

The aforementioned patented apparatus provided a mechanism wherein squat maneuvers were limited to only three squat positions as defined by one-quarter, one-half, and full squat positions. The position assembly 18 of the present invention provides a significantly greater number of stops for the squat positions so as to provide a greater range of exercise and rehabilitation maneuvers. As shown in FIGS. 1, 2, and 8, a substantial portion of the vertical length of the post 134 is provided with the plurality of closely spaced apart and throughgoing horizontal bores 142. An elongated rod 144 with a handle 145 thereon is selectively passed through any of these bores 142 and is in alignment with the rear frame member 34 so as to be contacted by the lower end of the rear frame member 34 as the back support assembly is moved downwardly towards the base assembly 12 during a squat maneuver. This contact between the frame member 34 and the rod 144 serves to stop or limit the squat to a selected degree of a full squat. A suitable vertical separation of the bores 142 may provide positioning the bores 142 at about every one-eighth of a full squat so as to provide sufficient stops for most squat maneuvers required for exercise and rehabilitation regimens. A rubber pad 148 is preferably placed at the base of the rear frame member 34 to provide a cushioning contact between the rear member 34 and the rod 144. Also, a stop for limiting the maximum downward travel of the back support assembly 16 to a full squat position is provided by a flange 150 on the post 134 near the base thereof. This flange 150 is of a sufficiently horizontal length so as to be contacted by the end of the frame support 34 when the rod 144 is not in place. This flange 150 is normally positioned about four inches from the base of the post 134, which spacing is sufficient for attaining a full squat position.

A further stop is provided by a lug 152 on the front frame member 32 and is adapted to be contacted by the lower frame member 38 during maximum upward movement of the frame assembly 14. The lug 152 is positioned to limit the upward movement of the frame assembly 14 where the upper and lower frame members 36 and 38 are inclined at a maximum angle of about 45° to the horizon. This maximum pivot angle assures that the back support assembly moves up and down along the desired arcuate path rather than rotating back and forth as would occur if an angle greater than about 45° is achieved during the uplift segment of the squat maneuver.

Figure 10:
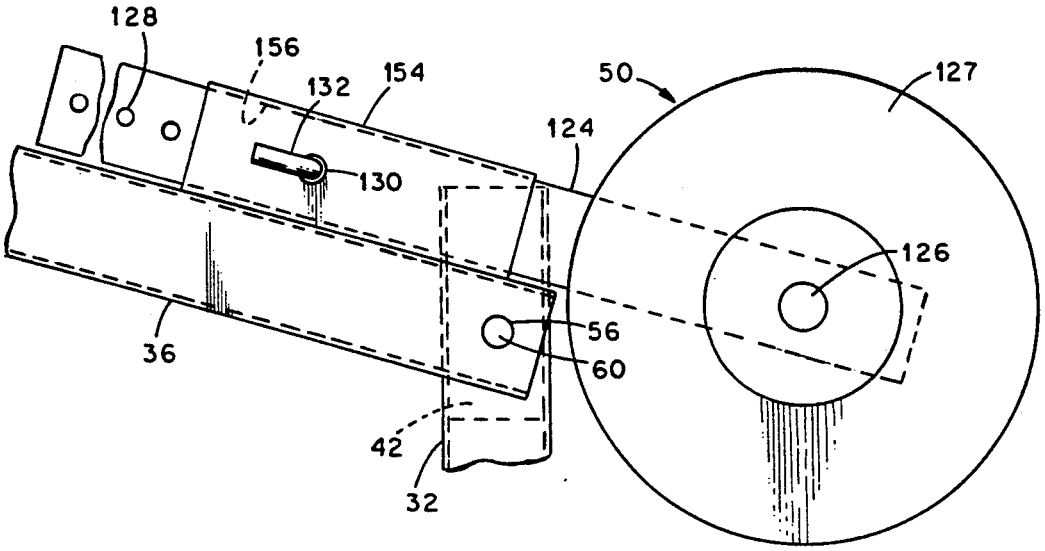
FIG. 10 is a fragmentary side view showing a further embodiment of the telescoping counter balancing arrangement.

As shown in FIG. 10, a further embodiment to the counter balancing assembly 50 may be utilized in the practice of the present invention whereby the offset or flange-type segments 52 and 54 on the upper frame member 36 may be eliminated. In this embodiment the plugs 45 and 46 in the upper frame member 36 are placed in the ends thereof in a manner similar to the plugs in the ends of the lower frame member 38. In this embodiment a short, i.e., about 6–8 inches, segment 154 of square tubular stock, which may be of the same cross-sectional dimensions as that of the tubular upper frame member 36, is attached to the upper surface of the upper member 36 at a location generally overlying the front frame member 32. The tubular segment 154 is provided with a throughgoing passageway 156 for receiving the tubular elongated body 124 of the counter balance assembly 50 as shown in FIG. 10, the bores 128 in the body 124 and the bore 130 in the tubular segment 154 are horizontally disposed so that the pin 132 engages the bores 128 from the side of the tubular segment 154.

Figure 11:
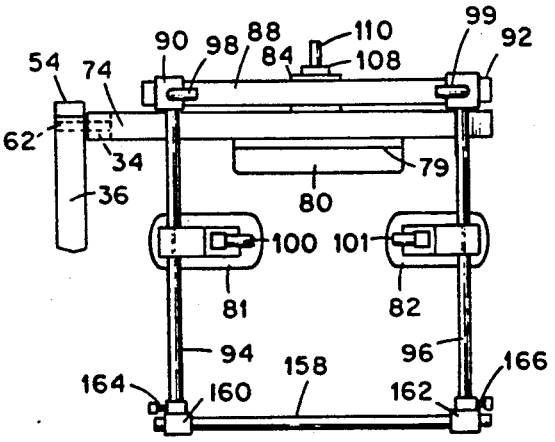
FIG. 11 is a top view showing details of the back support assembly in which a transverse bar is appropriately positioned for achieving bar bell-type squat maneuvers.

A still further embodiment of the present invention is shown in FIG. 11, where a removable cross bar 158 is transversely positioned across the outermost or outboard ends of the shoulder block supporting arms 94 and 96. This cross bar 158 provides a mechanism by which the user may grasp the bar 158 and utilize the present apparatus for bar bell-type squats. In such an operation or exercise the back of the user would be placed against the back support 78 and then the user would raise and lower the back assembly 16 through the desired squat positions by using the bar 158 rather than the shoulder blocks 81 and 82. The cross bar 158 may be removable attached to the arms 94 and 96 by using simple T-shaped collars 160 and 162 with suitable clamps 164 and 166.

In order to provide a more facile understanding of the present invention, a typical exercising procedure using the squat maneuvers in accordance with the teachings of the present invention is set forth below. With reference to the accompanying drawings, the user desiring to undergo squat maneuvers, initially positions the back support assembly 16 at its uppermost position with the elongated tubular member 138 engaging the top of the post 134. The user then gets into position against the back support assembly 78 for determining the vertical position of the shoulder blocks 81 and 82 so that the entire body of the user may be fully erect. At this point in the operation the shoulder blocks 81 and 82 are adjusted in their vertical position by moving the tubular channel member 86 and then fixing it in place by employing the pin 106 in the tubular member 84. Also, the spacing between the shoulder blocks 81 and 82 may be readily adjusted by sliding the collars 90 and 92 closer to or further away from one another to fit the user. With the shoulder blocks appropriately positioned, including horizontally on the arms 94 and 96 if desired, the weight desired for the exercise may be placed upon the rod 120, preferably after the counter balance 50 has been telescopically moved to a counter balance location where the full weight used in resisting the squat maneuvers is provided by the weights 120. The back of the user is then positioned against the back support 78 and the belt 114 placed about the waist of the user to maintain the body of the user in good contact with the back support during the squat maneuvers. The elongated tubular member 138 is withdrawn from contact with the top of the post 134 so as to allow the user to perform the squat maneuvers. The extent of the squat maneuver is preferably initially provided by positioning the rod 144 in an appropriate bore 142. However, if desired the user may perform the squat maneuvers without the rod 144 in place. When the desired number of repetitions of the squat maneuver is completed the user stands upright and the elongated tubular member 138 is then moved back into contact with the top of the post 134 to lock the back support assembly 16 in its initial or starting position.

It will be seen that the present invention provides a substantial improvement in the apparatus used for squat-type exercises by providing an apparatus of relatively simple construction which can perform all of the squatting maneuvers previously achievable by a much heavier and more complex apparatus. The present invention can be readily utilized in various hospitals, physical therapy clinics, and gymnasiums where the user of such an apparatus would be beneficial. Further, by using a lighter and smaller version of the present invention, it can be readily used in the home or other places where size and weight restrictions are present.

What is claimed is:

1. Apparatus for exercising or rehabilitating joints or muscles in the legs, hip and back of a user comprising:

horizontally oriented base means;

a single vertically displaceable frame means pivotally attached to said base means and comprising uniformly spaced apart elongated upper and lower member connected to uniformly spaced apart elongated first and second end members at vertically spaced apart locations thereon for defining a parallelogram from the interconnected members, said first end member being fixedly attached to said base means and vertically extending therefrom and the upper and lower members being pivotally attached at one end thereof to the first end member and at an opposite end thereof to the second end member, whereby vertical displacement of the frame means provides for vertically displacing the second end member along an arcuate path while maintaining the frame means in the from of a parallelogram with the second end member being maintained in a plane perpendicular to said base means and parallel to the first end member;

elongated back support means disposed in a location laterally spaced from said frame means and overlying said base means with said back support means being cantileveredly supported by said second end member in a vertical orientation for displacement therewith along said arcuate path while maintaining the back support means perpendicular to said base means;

means associated with the back support means adapted to be contacted by the user while the back of the user bears against the back support means for effecting displacement of the back support means along said arcuate path;

elongated post means attached to said base means and vertically, extends therefrom at a location longitudinally spaced from said second end member; and elongated displaceable means carried by said second end member and selectively displaceable in a horizontal plane substantially parallel to said base means for contacting said post means to position the back support means supported by said second end member at a selected location vertically spaced from said base means prior to and subsequent to vertical displacements of said back support means by the user.

2. An apparatus as claimed in claim 1, wherein shaft means extend between and engage contiguously disposed portions of said members for providing the pivotable attachments therebetween, wherein bore means in each of said members are adapted to receive said shaft means, and wherein said shaft means are received in said bore means in a substantially pressed fit manner and provide an axis of rotation for said upper and lower members for permitting pivotable movement thereof with respect to the first and second end members.

3. An apparatus as claimed in claim 2, wherein said first and second end members and said upper and lower members are formed of square tubular stock, wherein portions of the tubular stock adjacent to each of said shaft means is provided with a substantially solid cross section, wherein said bore means are in and extend through each of the substantially solid cross sections in the tubular stock, and wherein each of said shaft means extend in said bore means at least substantially through and is encompassed in said substantially pressed fit manner by each substantially solid cross section provided in the tubular stock.

4. An apparatus as claimed in claim 2, wherein said first and second end members and said upper and lower members are formed of square tubular stock, wherein a portion of the tubular stock adjacent to each of said shaft means in said first and second end members is provided with a substantially solid cross section, wherein said bore means are in and extend through each of the substantially solid cross sections in the tubular stock, wherein first end portions of each of said shaft means are fixedly attached to said upper and lower members, and wherein second end portions of each of said shaft means extend in said bore means at least substantially through and is encompassed in said substantially pressed fit manner by each substantially solid cross section provided in the tubular stock in said first and second end members.

5. An apparatus as claimed in claim 4, wherein the tubular stock defining the upper member has portions thereof containing the bore means provided by flange-like sections attached to the upper member adjacent to opposite longitudinal ends thereof, wherein the tubular stock defining the upper member has openings thereinto at said opposite ends, and wherein weight support means are adapted to be telescopically received in the opening at the end of the upper member adjacent to said first end member.

6. An apparatus as claimed in claim 1, wherein further elongated means are supportable by said post means at any of a plurality of vertically spaced apart locations thereon and are horizontally extendable therefrom and engageable with said second end member for selectively limiting the vertical displacement of said back support means towards said base means from said selected location above said base means.

7. An apparatus as claimed in claim 6, wherein said post means is provided with a plurality of throughgoing horizontally extending passageways at vertically spaced apart locations thereon for providing said plurality of vertically spaced apart locations, and wherein said further elongated means comprises an elongated rod extendable through any of passageways for contact with a lower end surface on said second end member.

8. An apparatus as claimed in claim 1, wherein weight support means are carried by said upper member in receptacle means at a location adjacent to said first end member, and wherein said weight support means are longitudinally displaceable with respect to said upper member to position a weight supportable by the weight support means at selected locations away from said second end member for providing a selected level of counterbalance to said frame means and the back support means supported thereby.

9. An apparatus as claimed in claim 8, wherein at least the upper and lower members are formed of elongated square tubular stock, and wherein said receptacle means is provided by an end portion of the tubular stock forming the upper member.

10. An apparatus as claimed in claim 8, wherein at least the upper and lower members are formed of elongated square tubular stock, and wherein said receptacle means is provided by an elongated hollow body attached to an uppermost surface of the upper member.

11. An apparatus as claimed in claim 8, wherein said weight support means comprises an elongated body having means at one end thereof for supporting said selected weight, wherein said receptacle means are adapted to telescopically receive a substantial length of said elongated body extending from said one end thereof, and wherein selectively operatable means are carried by said receptacle means for engaging said elongated body for securing the latter in the receptacle means for positioning the weight supportable thereby to provide said selected level of counterbalancing.

12. An apparatus as claimed in claim 11, wherein further weight support means are attached to said second end member and are adapted to support a weight thereon indicative of the resistance desired by the user against upward displacement of said back support means.

13. An apparatus as claimed in claim 12, wherein said further weight support means comprises an elongated horizontally disposed rod attached to said second end member at a location intermediate said upper and lower members, and wherein the said second end member is disposed between said further weight support means and said back support means.

14. An apparatus as claimed in claim 1, wherein said back support means comprises a vertically oriented rectangular body, wherein at least two elongated horizontally disposed support members are attached only to said second end member at vertically spaced apart locations thereon, and wherein said back support means are attached to said support members at a location thereon horizontally spaced from said second end member for the cantileveredly supporting the back support means in a vertical plane laterally spaced from and parallel with said second end member.

15. An apparatus as claimed in claim 14 wherein vertically oriented rod means are positioned adjacent to opposite sides of the rectangular body of the back support means and extend between and are attached to said horizontally disposed support members, and wherein adjustable strap means adapted to maintain the back of the user in contact with the rectangular body of the support means are attached to and are vertically movable on the vertically oriented rod means.

16. An apparatus as claimed in claim 14, wherein said means associated with the back support means adapted to be contacted by the user comprises a pair of elongated rod means disposed adjacent to the rectangular body of the back support means with said pair of elongated rod means being separated from one another by said rectangular body, wherein said elongated rod means extend substantially horizontally from said back support means in vertical planes laterally spaced from and parallel to said upper and lower end members of the single frame means and are of a sufficient length to be contacted by the user, wherein the elongated rod means are supported by said horizontally disposed support members, and wherein adjustable means attach said elongated rod means to said horizontally disposed support members for providing selective lateral or vertical positioning of the elongated rod means with respect to the rectangular body of the back support means.

17. An apparatus as claimed in claim 16, wherein shoulder block means adapted to be contacted by the shoulders of the user are carried by each of the elongated rod means, and wherein adjustable means attach said shoulder block means to the elongated rod means for providing selective positioning of the shoulder blocks along the length of the elongated rod means.

18. An apparatus as claimed in claim 16, wherein further rod means extend between and are coupled to the elongated rod means at a location spaced from the rectangular body of the back support means for contact by the user to effect vertical displacement of the back support means.

* * * * *

UNITED STATES PATENT AND TRADEMARK OFFICE

CERTIFICATE OF CORRECTION

PATENT NO. : 5,108,095

DATED : April 28, 1992

INVENTOR(S) : Raymond L. Nichols

It is certified that error appears in the above-identified patent and that said Letters Patent is hereby corrected as shown below:

On the Title page, item [57],

Abstract, line 5

Delete "rectanglar", and insert --rectangle-- therefor.

Column 1, line 56

Delete "meneuvers" and insert --maneuvers-- therefor.

Column 5, line 46

Delete "ar" and insert --are-- therefor.

Column 7, line 65

Delete "3" and insert --32-- therefor.

Column 8, line 44

Delete "8" and insert --82-- therefor.

Column 10, line 21

After "support for", insert --bar--.

Column 11, line 22

Delete "displaced" and insert --disposed-- therefor.

UNITED STATES PATENT AND TRADEMARK OFFICE

CERTIFICATE OF CORRECTION

PATENT NO. : 5,108,095

DATED : April 28, 1992

INVENTOR(S) : Raymond L. Nichols

It is certified that error appears in the above-identified patent and that said Letters Patent is hereby corrected as shown below:

Column 13, line 45

Delete "user", and insert --use-- therefor.

Column 13, line 68

Delete "from" and insert --form -- therefor.

Column 14, line 18

After "vertically" delete --,--.

Signed and Sealed this

Seventeenth Day of August, 1993

Bruce Lehman

*Attest:*

BRUCE LEHMAN

*Attesting Officer*

*Commissioner of Patents and Trademarks*